US009983604B2

(12) United States Patent
Lee et al.

(10) Patent No.: US 9,983,604 B2
(45) Date of Patent: May 29, 2018

(54) LOW DROP-OUT REGULATOR AND DISPLAY DEVICE INCLUDING THE SAME

(71) Applicants: Samsung Electronics Co., Ltd., Suwon-si (KR); Korea University Research and Business Foundation, Seoul (KR)

(72) Inventors: JaeYoul Lee, Hwaseong-si (KR); Jeongpyo Kim, Seoul (KR); Yong Sin Kim, Seoul (KR); Seong Jin Yun, Seoul (KR)

(73) Assignees: Samsung Electronics Co., Ltd., Suwon-si (KR); Korea University Research and Business Foundation, Seoul (KR)

( * ) Notice: Subject to any disclaimer, the term of this patent is extended or adjusted under 35 U.S.C. 154(b) by 57 days.

(21) Appl. No.: 14/874,758

(22) Filed: Oct. 5, 2015

(65) Prior Publication Data

US 2017/0097649 A1 Apr. 6, 2017

(51) Int. Cl.

| | |
|---|---|
| ***G09G 5/00*** | (2006.01) |
| ***G05F 1/575*** | (2006.01) |
| ***G09G 3/36*** | (2006.01) |

(52) U.S. Cl.

CPC ..... *G05F 1/575* (2013.01); *G09G 3/3696* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 6,541,946 | B1 | 4/2003 | Chen et al. | |
| 2004/0140845 | A1 | 7/2004 | Eberlein | |
| 2005/0225306 | A1 | 10/2005 | Oddoart et al. | |
| 2006/0273771 | A1 | 12/2006 | Van Ettinger et al. | |
| 2007/0129903 | A1* | 6/2007 | Shiratsuchi | H03F 1/3211 702/66 |
| 2008/0129424 | A1* | 6/2008 | Golden | H03H 11/481 333/214 |
| 2009/0001953 | A1 | 1/2009 | Huang | |
| 2010/0141223 | A1 | 6/2010 | Wadhwa | |
| 2010/0327830 | A1* | 12/2010 | Kuan | G05F 1/56 323/282 |
| 2012/0049959 | A1 | 3/2012 | Wang et al. | |
| 2012/0223688 | A1 | 9/2012 | Iriarte et al. | |
| 2012/0293562 | A1* | 11/2012 | Park | G09G 3/3233 345/690 |
| 2013/0082672 | A1 | 4/2013 | Kim et al. | |
| 2013/0271094 | A1 | 10/2013 | Sun et al. | |
| 2015/0123628 | A1 | 5/2015 | Bhattad et al. | |

* cited by examiner

*Primary Examiner* — Ifedayo Iluyomade

(74) *Attorney, Agent, or Firm* — H.C. Park & Associates, PLC

(57) ABSTRACT

A low drop-out (LDO) regulator includes a pass transistor, a feedback circuit, an error amplifier, and a compensation unit. The pass transistor is configured to regulate a power supply and output an output voltage according to a control signal. The feedback circuit is configured to generate a feedback voltage based on the output voltage. The error amplifier is configured to output a comparison signal in response to a reference voltage and the feedback voltage. The compensation circuit is configured to generate a negative capacitance in association with a first node connected to a gate electrode of the pass transistor.

16 Claims, 7 Drawing Sheets

LOW DROP-OUT REGULATOR AND DISPLAY DEVICE INCLUDING THE SAME

BACKGROUND

Field

Exemplary embodiments relate to a low drop-out (LDO) regulator, and, more particularly, to an LDO regulator with improved power supply rejection ratio (PSRR) and a display device including the same.

Discussion

Voltage regulators may be used to provide stable power to electronic devices, such as display devices, or components thereof. The voltage regulators may be classified into switching regulators and linear regulators.

A direct current (DC)-to-DC converter is a type of switching regulator that may, in comparison to linear regulators, exhibit relatively high conversion efficiency, but may produce noise in output voltages. An LDO regulator is a type of linear regulator that may have relatively lower conversion efficiency, but may have relatively high response speed. An output voltage from an LDO regulator may be less than an input voltage supplied thereto, and, as such, may incur a power loss. It is noted, however, that the LDO regulator may provide a stable power output. Further, the output voltage of the LDO regulator may include less noise than the noise in the output voltage of a DC-to-DC converter. Accordingly, an LDO regulator may replace or supplement a DC-to-DC converter to supply power in noise-sensitive electronic devices or high performance electronic devices.

A power supply rejection ratio (PSRR) is a ratio between noise in an input voltage supplied to a power supply and noise in an output voltage. The PSRR may indicate a level of stability in supplying voltage by a voltage regulator in a determined frequency range, through which noise in the input voltage may be reduced. In a voltage regulator, noise in an input voltage may prevent it from maintaining a stable output voltage. Since effectively blocking noise from the input voltage supplied to a voltage regulator in a high frequency range (which may be higher than a gain crossover frequency in a closed loop of the linear regulator by hundreds of KHz or MHz) may be difficult, it is concomitantly difficult to maintain a stable output voltage in the high frequency range.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a low drop-out (LDO) regulator with improved power supply rejection ratio (PSRR).

Exemplary embodiments provide a display device including an LDO regulator with improved PSRR.

Additional aspects will be set forth in the detailed description which follows, and, in part, will be apparent from the disclosure, or may be learned by practice of the inventive concept.

According to exemplary embodiments, an LDO regulator includes a pass transistor configured to regulate an input according to a control signal, and a compensation circuit configured to provide a negative capacitance to a gate node of the pass transistor. The control signal is formed based on feedback associated with the pass transistor, a reference input, and the negative capacitance.

According to exemplary embodiments, an LDO regulator includes a pass transistor configured to regulate a power supply and output an output voltage according to a control signal, a feedback circuit configured to generate a feedback voltage based on the output voltage, an error amplifier configured to output a comparison signal in response to a reference voltage and the feedback voltage, and a compensation circuit configured to generate a negative capacitance in association with a first node connected to a gate electrode of the pass transistor.

According to exemplary embodiments, a display device includes a display panel including gate lines, data lines, and pixels, a gate driver configured to output a gate signal to the gate lines, a source driver configured to output data voltage to the data lines, and a voltage generator configured to receive an input voltage, convert the input voltage to an analog voltage, and output the analog voltage to at least one of the gate driver and the source driver. The voltage generator includes a DC-to-DC converter and a LDO regulator. The LDO regulator includes a compensation circuit configured to generate a negative capacitance.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
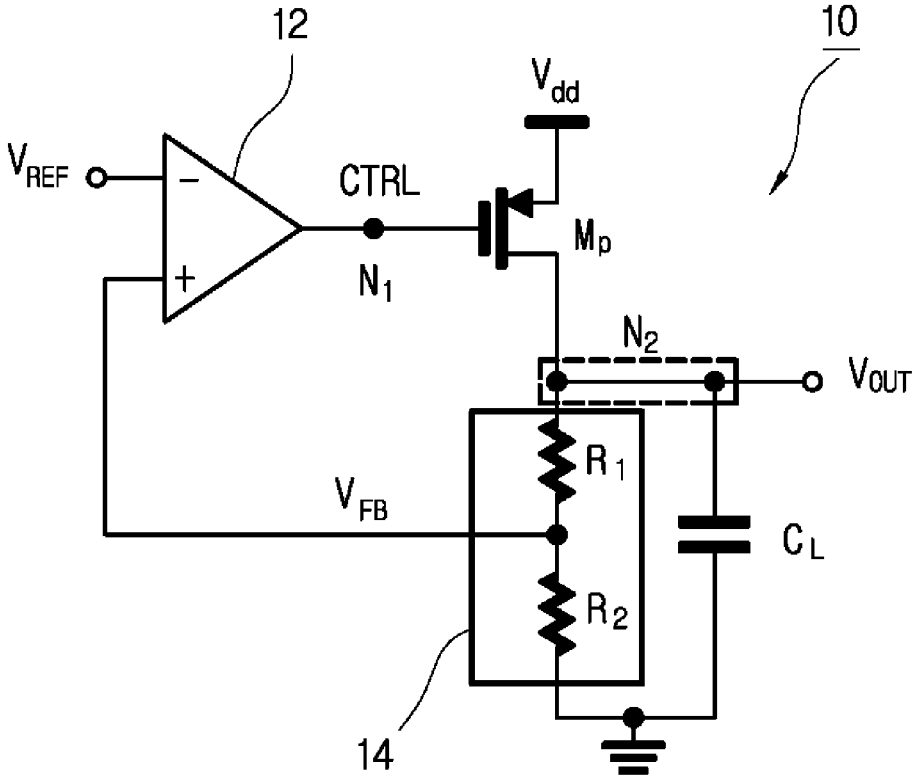
FIG. 1 (Prior Art)
FIG. 1 is a circuit diagram of a conventional LDO regulator.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of panels, circuit components, etc., may be exaggerated for clarity and descriptive purposes. Also, like reference numerals denote like elements.

When an element or component is referred to as being "on," "connected to," or "coupled to" another element, it may be directly on, connected to, or coupled to the other element or intervening elements may be present. When, however, an element or component is referred to as being "directly on," "directly connected to," or "directly coupled to" another element or component, there are no intervening elements or components present. For the purposes of this disclosure, "at least one of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, and/or sections, these elements, components, and/or sections should not be limited by these terms. These terms are used to distinguish one element, component, and/or section from another element, component, and/or section. Thus, a first element, component, and/or section discussed below could be termed a second element, component, and/or section without departing from the teachings of the present disclosure.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
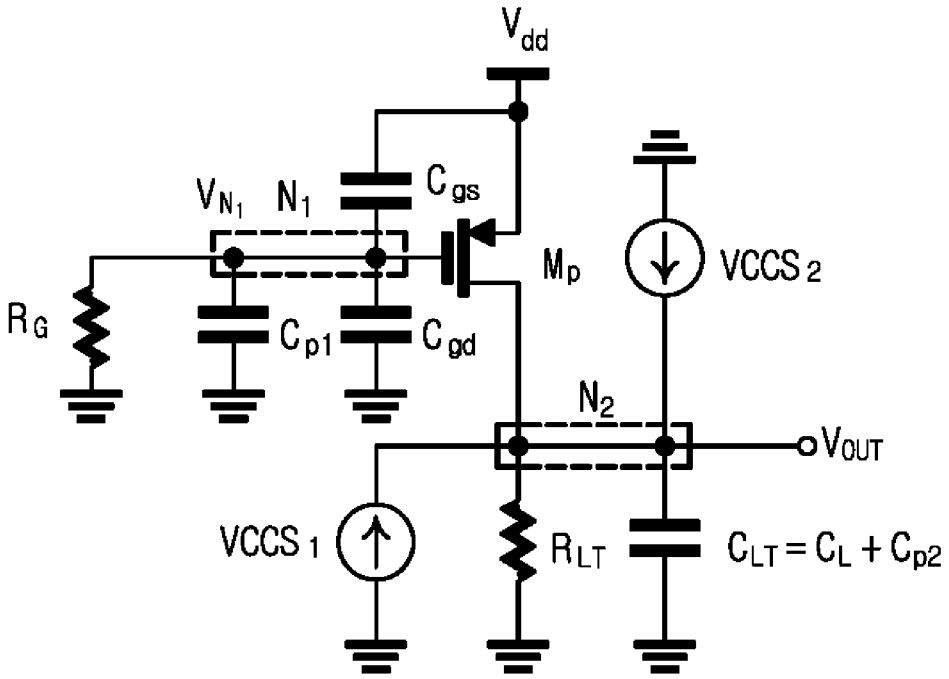
FIG. 2 (Prior Art)
FIG. 2 is a small-signal modeling diagram of the conventional LDO of FIG. 1.

FIG. 1 is a circuit diagram of a conventional LDO regulator. FIG. 2 is a small-signal modeling diagram of the conventional LDO regulator of FIG. 1.

Referring to FIG. 1, LDO regulator 10 may regulate power supply $V_{dd}$ and output a regulated power supply to a load. LDO regulator 10 may include pass transistor $M_p$, error amplifier 12, feedback circuit 14, and output load capacitor $C_L$.

Pass transistor $M_p$ may include a first electrode coupled to power supply $V_{dd}$ and a second electrode connected to second node $N_2$, such that the regulated power supply is output via second node $N_2$. Pass transistor $M_p$ may receive control signal CTRL to control output voltage $V_{OUT}$ to correspond to power supply $V_{dd}$. That is, a voltage level of output voltage $V_{OUT}$ may correspond to a magnitude of control signal CTRL. Pass transistor $M_p$ may be a p-type transistor, e.g., a p-channel metal-oxide-semiconductor field-effect transistor (pMOSFET).

Feedback circuit 14 may generate feedback voltage $V_{FB}$ in response to output voltage $V_{OUT}$, and may include first resistor $R_1$ and second resistor $R_2$ connected in series between second node $N_2$ and ground. Feedback voltage $V_{FB}$ may be a distributed output voltage $V_{OUT}$ by first and second resistors $R_1$ and $R_2$. Feedback circuit 14 may supply feedback voltage $V_{FB}$ to error amplifier 12.

Error amplifier 12 may receive reference voltage $V_{REF}$ and feedback voltage $V_{FB}$ through an inverted terminal (−) and a non-inverted terminal (+), respectively, and compare reference voltage $V_{REF}$ and feedback voltage $V_{FB}$. Error amplifier 12 may output a comparison signal to first node $N_1$ connected to the gate electrode of pass transistor $M_p$ according to a result of the comparison. The comparison signal may be applied to pass transistor $M_p$ as control signal CTRL.

The comparison signal may include information relating to a change in output voltage $V_{OUT}$ of LDO regulator 10. That is, feedback voltage $V_{FB}$ may change in response to a change in output voltage $V_{OUT}$, and error amplifier 12 may generate the comparison signal according to the change in feedback voltage $V_{FB}$. For example, when feedback voltage $V_{FB}$ is less than reference voltage $V_{REF}$, the comparison signal of error amplifier 12 may control pass transistor $M_p$ to increase the level of output voltage $V_{OUT}$. When feedback voltage $V_{FB}$ is greater than reference voltage $V_{REF}$, the comparison signal may control pass transistor $M_p$ to decrease the level of output voltage $V_{OUT}$. Accordingly, pass transistor $M_p$ may change the level of output voltage $V_{OUT}$ to stabilize output voltage $V_{OUT}$ in response to the comparison signal operating as control signal CTRL. As such, LDO regulator 10 may generally maintain a stable output by using a feedback signal. However, when noise is present in power supply $V_{dd}$, control signal CTRL applied to pass transistor $M_p$ may also include noise according to a signal flow within a loop formed via pass transistor $M_p$, feedback circuit 14, and error amplifier 12. In this manner, control signal CTRL may not effectively control pass transistor $M_p$.

FIG. 2 is a small-signal modeling diagram of the conventional LDO regulator of FIG. 1.

Referring to FIG. 2, parasitic capacitor $C_{p1}$ may be formed in association with first node $N_1$ connected to the gate electrode of pass transistor $M_p$. Parasitic capacitor $C_{p1}$ may be formed based on a layout of error amplifier 12, which is disposed adjacent to first node $N_1$. Gate-source capacitor $C_{gs}$ may be formed between gate and source electrodes of pass transistor $M_p$, and gate-drain capacitor $C_{gd}$ may be formed between gate and drain electrodes of pass transistor $M_p$. First and second voltage-controlled current sources $VCCS_1$ and $VCCS_2$, resistive load $R_{LT}$, and effective load capacitor $C_{LT}$ accounting for output load capacitor $C_L$ and second parasitic capacitor $C_{p1}$ may be connected to (or otherwise associated with) second node $N_2$. Second parasitic capacitor $C_{p1}$ may be formed in association with second node $N_2$. For example, second parasitic capacitor $C_{p1}$ may be associated with a layout of a load device. In FIG. 2, for descriptive convenience, gate-drain capacitor $C_{gd}$ is illustrated as being formed between first node $N_1$ and ground, and first and second voltage-controlled current sources $VCCS_1$ and $VCCS_2$ are formed between the drain electrode and ground.

First node voltage $V_{N1}$ of first node $N_1$ may be generated by power supply $V_{dd}$, regardless of the comparison signal output from error amplifier 12. When noise is included in power supply $V_{dd}$, power supply $V_{dd}$ may include a frequency component, such that first node voltage $V_{N1}$ may be expressed as Equation 1, according to the small-signal modeling diagram of FIG. 2.

$$V_{N1} = \frac{sC_{gs}}{\frac{1}{R_g} + s(C_{p1} + C_{gs} + C_{gd})} V_{dd} \cong \frac{C_{gs}}{C_{p1} + C_{gs} + C_{gd}} V_{dd} \quad \text{Eq. 1}$$

In Equation 1, "s" denotes a Laplace variable and "$R_G$" denotes a lump resistance connected to first node $N_1$. According to Equation 1, first node voltage $V_{N1}$ of first node $N_1$ may change in different degrees with respect to power supply $V_{dd}$. When noise is included in power supply $V_{dd}$, first node voltage $V_{N1}$ may change to a lesser degree than power supply $V_{dd}$, due to parasitic capacitor $C_{p1}$ and gate-drain capacitor $C_{gd}$.

Gate-source voltage $V_{gs}$ (that may drive pass transistor $M_p$) may be a difference between a voltage applied to the source electrode (i.e., power supply $V_{dd}$) and a voltage of first node N1 (i.e., first node voltage $V_{N1}$). Accordingly, gate-source voltage $V_{gs}$ may change when power supply $V_{dd}$ and first node voltage $V_{N1}$ change in different degrees from each other. In this manner, control signal CTRL may not effectively control pass transistor $M_p$, because first node voltage $V_{N1}$ may change in different degrees with respect to power supply $V_{dd}$ even when the comparison signal from error amplifier 12 is constant. As such, the PSRR of LDO regulator 10 may be lowered. The PSRR of LDO regulator 10 may be further lowered when power supply $V_{dd}$ includes a higher frequency component. Accordingly, LDO regulator 10 may output an unstable output voltage $V_{OUT}$, when noise included in power supply $V_{dd}$ is of a high frequency component.

Referring back to FIG. 1, LDO regulator 10 may include large capacity output load capacitor $C_L$ connected to second node $N_2$ in order to stabilize output voltage $V_{OUT}$. In this manner, large capacity output load capacitor $C_L$ may be utilized to counteract the effects of relatively high output impedance off the second electrode of pass transistor $M_p$. However, it may be a design challenge to include large capacity load capacitor $C_L$ due to its large size.

According to exemplary embodiments, an LDO regulator may include a compensation circuit to remove (or at least reduce) the effects of parasitic capacitance in a node connected to a gate electrode of a pass transistor. In this manner, a voltage difference between gate and source electrodes in the pass transistor may be removed, which may also occur when noise is included in a power supply. As such, the compensation circuit may improve a PSRR of an LDO regulator. The compensation circuit may also eliminate the large capacity output load capacitor of the conventional LDO regulator 10 of FIG. 1, and still can stabilize an output voltage in a high frequency range. Accordingly, the LDO regulator according to exemplary embodiments may provide a stable voltage to downstream circuits, such as, for example, downstream analog circuits in a display driver integrated circuit (IC). To this end, the LDO regulator may enable the display driver IC to be formed with a relatively smaller form factor by eliminating a large capacity output load capacitor typically utilized in conventional LDO regulators.

Figure 3:
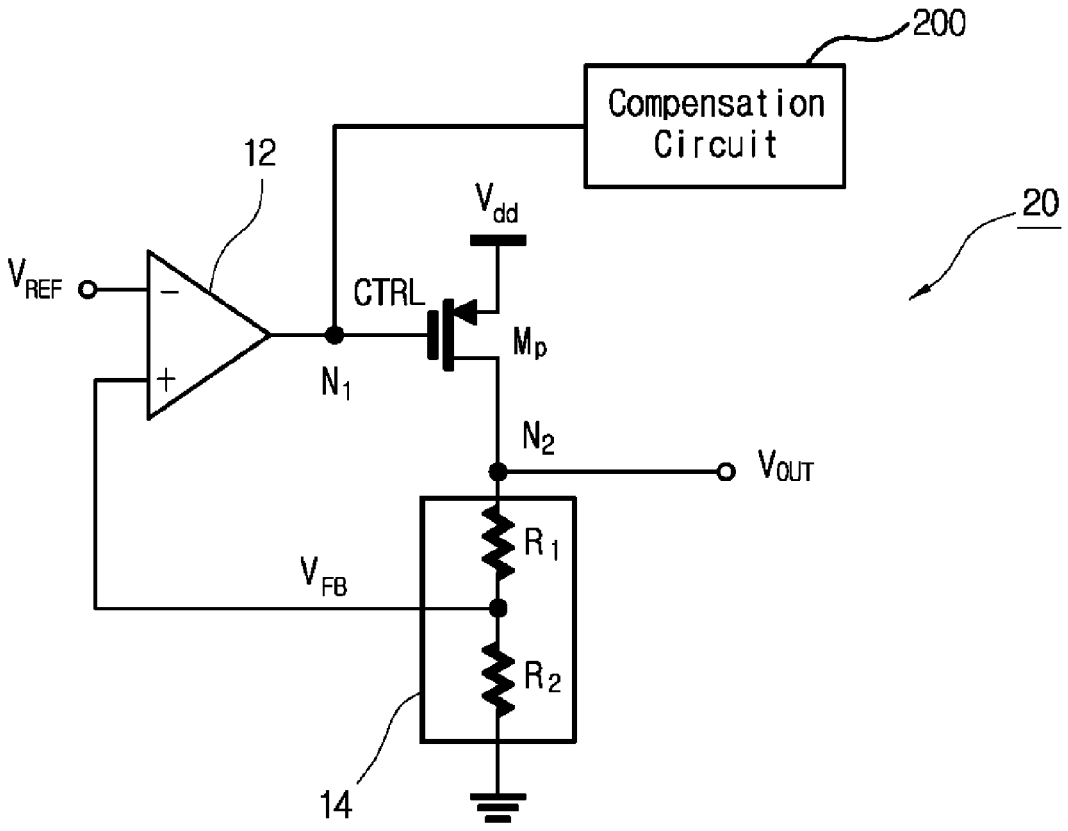
FIG. 3 is a circuit diagram of an LDO regulator, according to exemplary embodiments.
Figure 4:
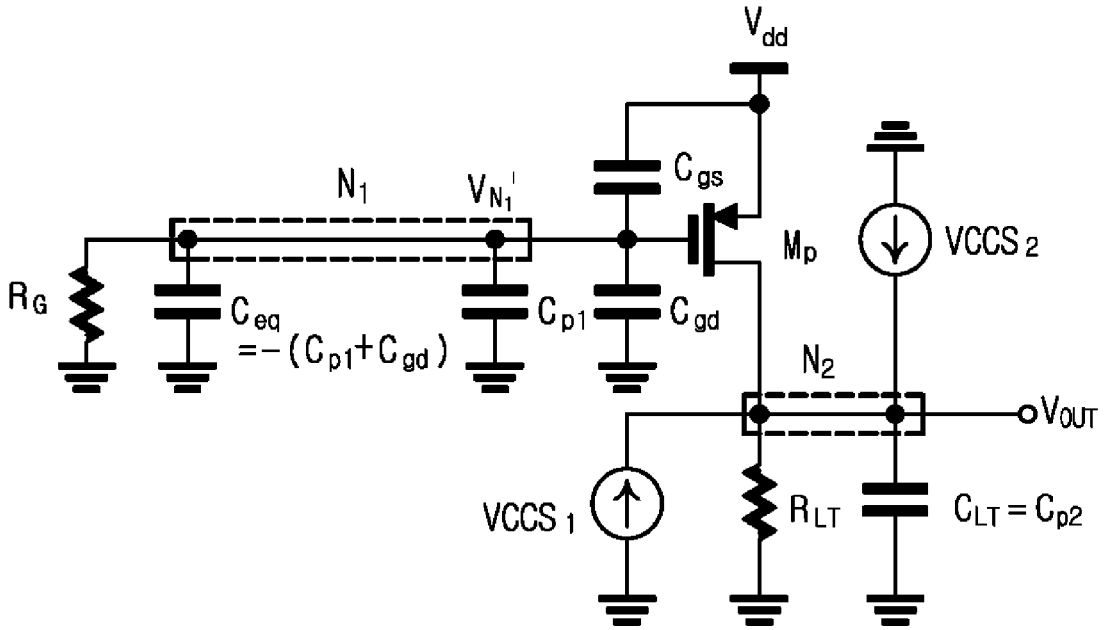
FIG. 4 is a small-signal modeling diagram of the LDO regulator of FIG. 3, according to exemplary embodiments.

FIG. 3 is a circuit diagram of an LDO regulator, according to exemplary embodiments. FIG. 4 is a small-signal modeling diagram of the LDO regulator of FIG. 3.

Referring to FIG. 3, LDO regulator 20 may include compensation circuit 200, but may not include large capacity output load capacitor $C_L$ of LDO regulator 10. In order to avoid obscuring exemplary embodiments described herein, similar components in LDO regulator 20 as LDO regulator 10 have the same reference numerals, and, as such, duplicative descriptions will be omitted. Compensation circuit 200 may generate a negative capacitance, of which an equivalent capacitance of compensation circuit 200 may have a negative value at first node $N_1$, which is upstream from pass transistor $M_p$. Referring to FIG. 4, equivalent capacitor $C_{eq}$ may have a negative capacitance, which may be a sum of parasitic capacitance $C_{p1}$ at first node $N_1$ and parasitic capacitance $C_{gd}$ between gate and drain electrodes of pass transistor $M_p$ (i.e., $-(C_{p1}+C_{gd})$).

Equivalent capacitor $C_{eq}$ may be connected in parallel with parasitic capacitor $C_{p1}$ and gate-drain capacitor $C_{gd}$ of pass transistor $M_p$.

First node voltage $V_{N1}'$ at first node $N_1$ may be generated according to power supply $V_{dd}$, regardless of a comparison signal of error amplifier 12. When noise is included in power supply $V_{dd}$, power supply $V_{dd}$ may include a frequency component from the noise, and first node voltage $V_{N1}'$ may be expressed as Equation 2, according to the small-signal modeling diagram illustrated in FIG. 4.

$$V_{N1}' = \frac{sC_{gs}}{\frac{1}{R_g} + s(C_{p1} + C_{gs} + C_{gd} - (C_{p1} + C_{gd}))} V_{dd} \cong \frac{C_{gs}}{C_{gs}} V_{dd} = V_{dd} \quad \text{Eq. 2}$$

Referring to Equation 2, first node voltage $V_{N1}'$ at first node $N_1$ may change in the same degree with power supply $V_{dd}$. For instance, when power supply $V_{dd}$ (that includes noise) changes, first node voltage $V_{N1}'$ may change in the same degree with respect to power supply $V_{dd}$ because equivalent capacitor $C_{eq}$ having the negative capacitance may remove the effect of parasitic capacitance $C_{p1}$ and gate-drain capacitance $C_{gd}$.

Gate-source voltage $V_{gs}$ (which may drive pass transistor $M_p$) may be a difference between a voltage input to a source electrode (i.e., $V_{dd}$) and a voltage of first node $N_1$ (i.e., $V_{N1}'$) of pass transistor $M_p$. As such, when power supply $V_{dd}$ and first node voltage $V_{N1}'$ change in the same degree, gate-source voltage $V_{gs}$ may remain constant. To this end, control signal CTRL may effectively control pass transistor $M_p$ when a comparison signal from error amplifier 12 is a constant voltage, as first node voltage $V_{N1}'$ and power supply $V_{dd}$ change in the same degree. This may increase a PSRR of LDO regulator 20.

According to exemplary embodiments, LDO regulator 20 may output a stable output voltage $V_{OUT}$ even when noise is included in power supply $V_{dd}$, which may even have high frequency components. Further, LDO regulator 20 may not require large capacity output load capacitor $C_L$ in association with second node $N_2$ as in LDO regulator 10. However, second parasitic capacitor $C_{p1}$ may be formed in association with second node $N_2$, which may serve as effective load capacitor $C_{LT}$ of LDO regulator 20. For example, second parasitic capacitor $C_{p1}$ may be associated with a layout of a load device (not illustrated), such as an analog circuit downstream from second node $N_2$.

Figure 5:
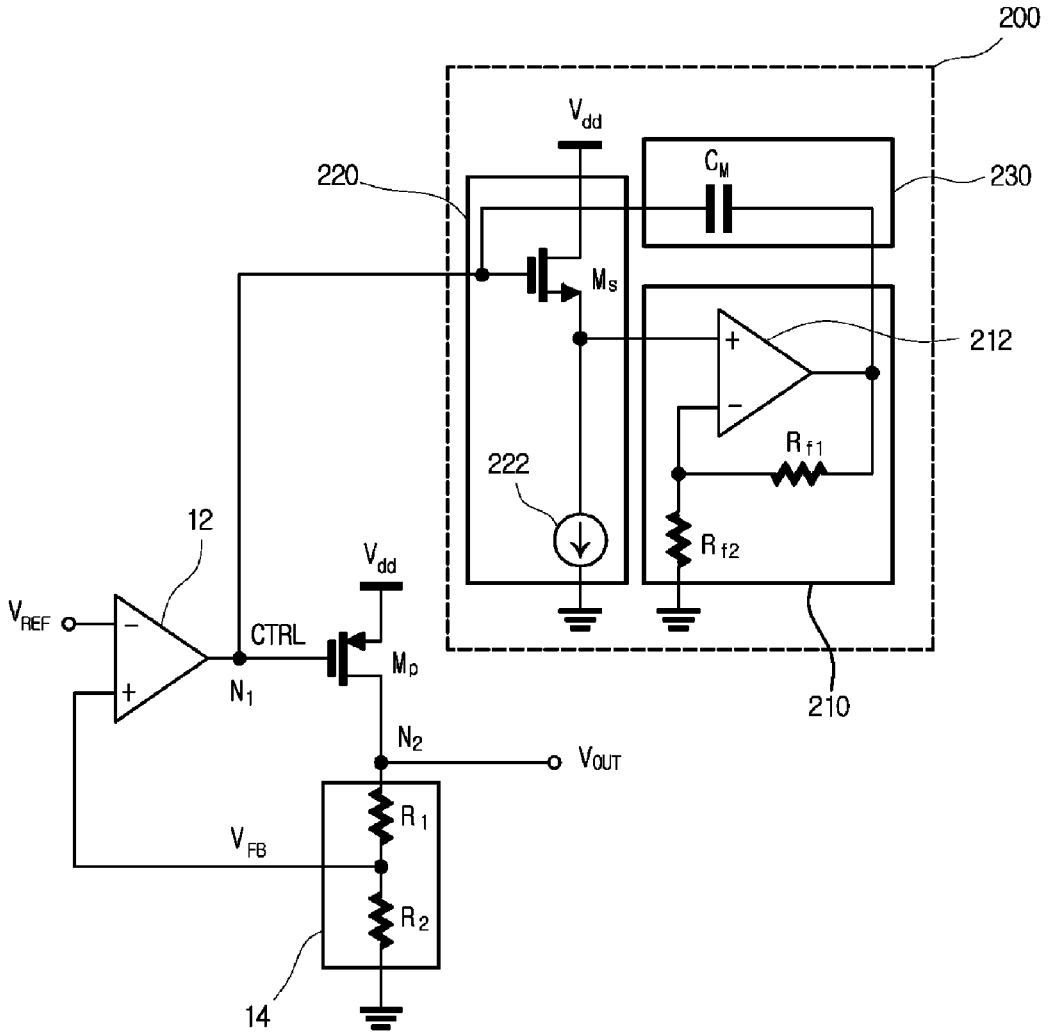
FIG. 5 is a circuit diagram of an LDO regulator including a compensation circuit, according to exemplary embodiments.

FIG. 5 is a circuit diagram of an LDO regulator including a compensation circuit, according to exemplary embodiments.

Referring to FIG. 5, compensation circuit 200 may include non-inverted amplifier 210, source follower circuit 220, and compensation capacitor $C_M$ 230.

Non-inverted amplifier 210 may include operational amplifier 212, first resistor $R_{f1}$ and second resistor $R_{f2}$ connected in series between an output terminal of operational amplifier 212 and ground. Control signal CTRL, which corresponds to a comparison signal of error amplifier 12, may be applied to a non-inverted terminal (+) of operational amplifier 212, and an output signal of operational amplifier 212 may be fed back and input to an inverted terminal (−) of operational amplifier 212. A gain of non-inverted amplifier 210 may be expressed as $1+R_{f1}/R_{f2}$. It is noted that the feedback to the inverted terminal (−) of operational amplifier 212 may be modified based on the presence of first and second resistors $R_{f1}$ and $R_{f2}$.

The comparison signal output from error amplifier 12 may be input to the non-inverted terminal (+) of operational amplifier 212. It is noted, however, that a voltage level of the comparison signal may be a relatively high input signal to operational amplifier 212, and, as such, may prevent (or otherwise degrade) an intended performance of operational amplifier 212. Accordingly, compensation circuit 200 may include source follower circuit 220 to convert the comparison signal of error amplifier 12 into a lower voltage level.

In exemplary embodiments, source follower circuit 220 may include a n-type transistor $M_s$, such as n-channel MOSFET (nMOSFET), which may include a first electrode connected to power supply $V_{dd}$, a second electrode connected to current sink circuit 222, and a gate electrode configured to receive the comparison signal output from error amplifier 12. Source follower circuit 220 may lower the voltage level of the comparison signal output from error amplifier 12 by a threshold voltage of transistor $M_s$, which may then be applied to the non-inverted terminal (+) of operational amplifier 212. Current sink circuit 222 may form a current path from power supply $V_{dd}$ to ground, such that transistor $M_s$ may operate as a source follower.

Compensation capacitor $C_M$ 230 may be connected in parallel with non-inverted amplifier 210. According to exemplary embodiments, a first electrode of compensation capacitor $C_M$ 230 may be connected to an output terminal of non-inverted amplifier 210, and a second electrode of compensation capacitor $C_M$ 230 may be connected to a gate electrode of transistor $M_s$. Alternatively, the second electrode of compensation capacitor $C_M$ 230 may be connected to the non-inverted terminal (+) of operational amplifier 212.

When compensation capacitor $C_M$ 230 is connected in parallel with non-inverted amplifier 210, equivalent capacitance $C_{eq}$ from a viewpoint facing compensation circuit 200 (that is, equivalent capacitance $C_{eq}$ of compensation circuit 200 at first node $N_1$) may be expressed as Equation 3, according to a Miller effect.

$$C_{eq} = C_M(1 - A_{CL}) = C_M\left\{1 - \left(1 + \frac{R_{f1}}{R_{f2}}\right)\right\} = -C_M, \quad \text{when } R_{f1} = R_{f2} \qquad \text{Eq. 3}$$

In Equation 3, "$A_{CL}$" denotes a gain of non-inverted amplifier 210. According to Equation 3, equivalent capacitance $C_{eq}$ of compensation circuit 200 may have a desired negative capacitance by forming at least one of first resistor $R_{f1}$ and second resistor $R_{f2}$ of non-inverted amplifier 210 as a variable resistor and adjusting the resistance of first and second resistors $R_{f1}$ and $R_{f2}$ to control the ratio ($R_{f1}$:$R_{f2}$) therebetween, even when compensation capacitor $C_M$ 230 is relatively small in size. For instance, referring back to FIG. 4, when parasitic capacitance $C_{p1}$ from first node N1 and gate-drain capacitance $C_{gd}$ of pass transistor $M_p$ are determined, the ratio of first resistor $R_{f1}$ and second resistor $R_{f2}$ may be controlled to have a corresponding negative capacitance (i.e., $-(C_{p1}+C_{gd})$), to offset parasitic capacitance $C_{p1}$ and gate-drain capacitance $C_{gd}$ that are subject to compensation. Accordingly, LDO regulator 20 may improve PSRR by offsetting a voltage difference between gate and source electrodes of pass transistor $M_p$, even when noise is included in power supply $V_{dd}$. This may also enable the output of a stable output voltage in high frequency ranges through compensation circuit 200. Therefore, a large capacity output load capacitor, which is typically large in size, may be eliminated.

According to exemplary embodiments, compensation circuit 200 may have faster operational speed than error amplifier 12 of LDO regulator 20. As such, operational amplifier 212 of non-inverted amplifier 210 may have a wider operational bandwidth than error amplifier 12.

Figure 6:
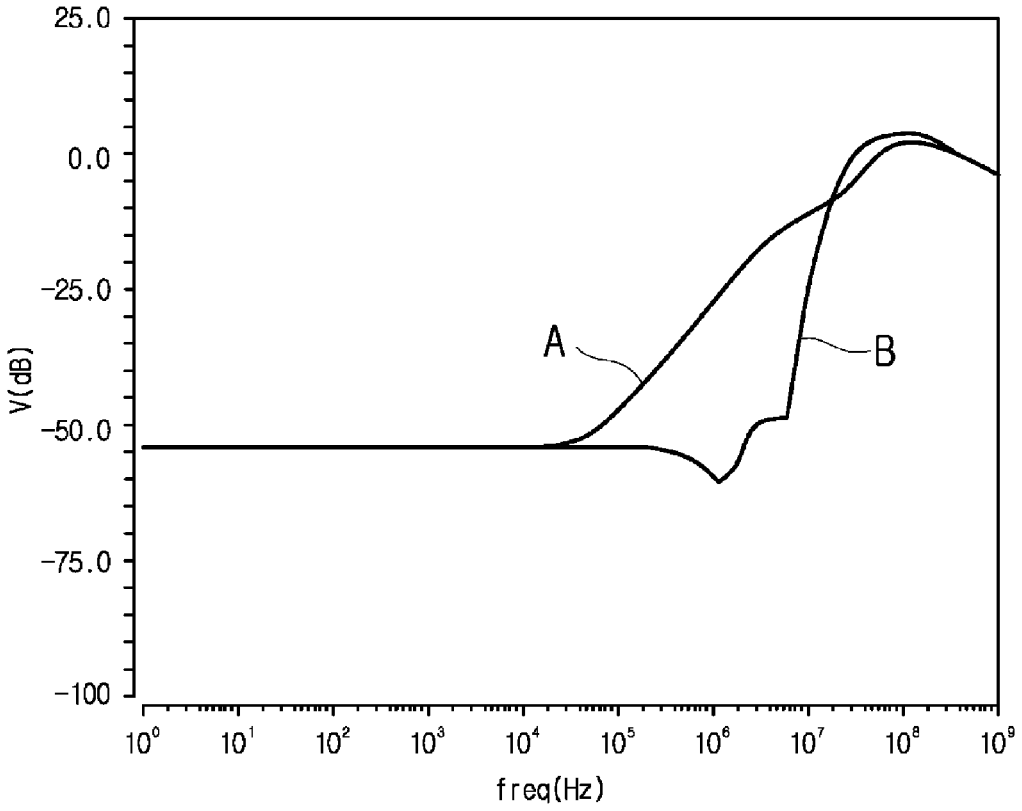
FIG. 6 is a graph comparing power supply rejection ratio of a conventional LDO regulator with power supply rejection ratio of an LDO regulator according to exemplary embodiments.

FIG. 6 is a graph comparing power supply rejection ratio of a conventional LDO regulator with power supply rejection ratio of an LDO regulator according to exemplary embodiments.

Line A represents a PSRR of conventional LDO regulator 10, whereas line B represents a PSRR of LDO regulator 20, which includes compensation circuit 200. A horizontal axis of the graph plots frequency component values of power supply $V_{dd}$ applied to an LDO regulator, and a vertical axis of the graph plots PSRR values of the LDO regulator expressed in decibel levels. In a given frequency value, an LDO regulator may have a higher PSRR as the PSRR value is further away from 0. Referring to FIG. 6, in a frequency range below 100 KHz, a range in which a PSRR of an LDO regulator may be determined based on a loop gain characteristic of the LDO regulator, LDO regulator 10 (line A) and LDO regulator 20 (line B) both illustrate relatively high PSRR. However, in a high frequency range over 1 MHz, a parasitic capacitance in a pass transistor may affect a PSRR of a conventional LDO regulator. In addition, noise having high frequency components may be included in power supply $V_{dd}$ in a high frequency range, which may also deteriorate the PSRR. As illustrated in FIG. 6, a PSRR of LDO regulator 10 (line A) in a high frequency range over 1 MHz is lower than in a low frequency range below 1 KHz.

LDO regulator 20 (line B) including compensation circuit 200 has an improved PSRR in a high frequency range over 1 MHz. That is, LDO regulator 20 (line B) including compensation circuit 200 has about 30 dB improvement in PSRR in a high frequency range between 1 MHz to 10 MHz compared to LDO regulator 10 (line A).

Figure 7:
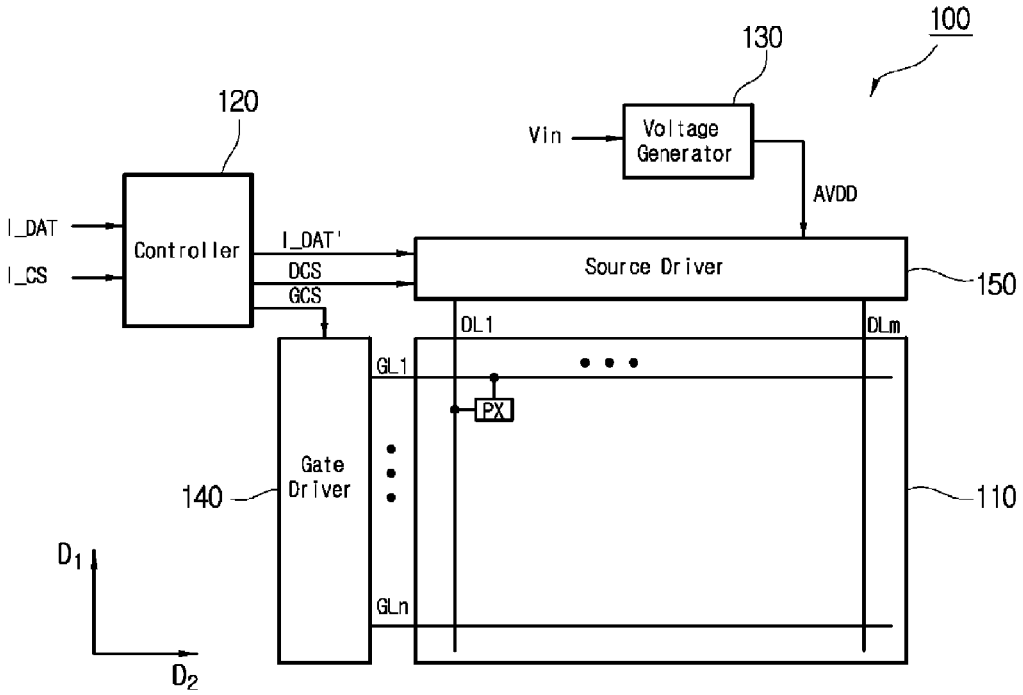
FIG. 7 is a block diagram of a display device including an LDO regulator, according to exemplary embodiments.
Figure 8:
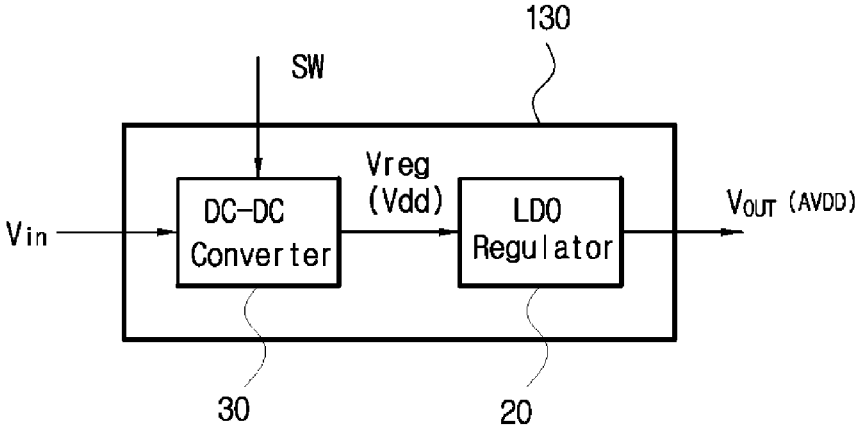
FIG. 8 is a block diagram of a voltage generator of the display device of FIG. 7, according to exemplary embodiments.

FIG. 7 is a block diagram of a display device including an LDO regulator, according to exemplary embodiments. FIG. 8 is a block diagram of a voltage generator of the display device of FIG. 7, according to exemplary embodiments.

Referring to FIGS. 7 and 8, display device 100 may include display panel 110, controller 120, voltage generator 130, gate driver 140, and source driver 150. Display device 100 is described in association with a liquid crystal display (LCD) device implementation, but may be applicable to any type of flat panel display device, such as a plasma display panel (PDP) device, an organic light emitting diode (OLED) device, a field emission display (FED) device, a electrophoretic display (EPD) device, an electrowetting display (EWD) device, etc.

Voltage generator 130 may include direct current (DC)-to-DC converter 30 and LDO regulator 20. Operations and components of LDO regulator 20 may be the same as those of LDO regulator 20 described in association with FIGS. 3 through 5, and, thus duplicative descriptions will be omitted.

Display panel 110 may include gate lines $GL_1$-$GL_n$, data lines $DL_1$-$DL_m$, and pixels PX. Gate lines $GL_1$-$GL_n$ may extend in first direction $D_1$ and may be arranged in second direction $D_2$ intersecting first direction $D_1$. Data lines $DL_1$-$DL_m$ may extend in second direction $D_2$ and may be arranged in first direction $D_1$. Although not illustrated, gate lines $GL_1$-$GL_n$ and data lines $DL_1$-$DL_m$ may be disposed in different layers, such as to intersect each other while being electrically insulated from each other. Pixels PX may be disposed in pixel areas defined by intersecting gate lines $GL_1$-$GL_n$ and data lines $DL_1$-$DL_n$.

Controller 120 may receive input image data I_DAT and image control signal I_CS from an image board, such as an external image board (not illustrated). Input image data I_DAT may be an image data signal input to display device 100 from outside. Controller 120 may convert input image data I_DAT in accordance with a specification of source driver 150, and apply converted input image data I_DAT' to source driver 150. Controller 120 may generate gate control signal GCS and data control signal DCS in response to image control signal I_CS. Gate control signal GCS and data control signal DCS may drive gate driver 140 and source driver 150, respectively.

Gate driver 140 may generate a gate signal in response to receiving gate control signal GCS, and sequentially output the gate signal to gate lines $GL_1$-$GL_n$. Source driver 150 may receive converted input image I_DAT' and data control signal DCS from controller 120, convert the converted input image I_DAT' to a data voltage in response to receiving the data control signal DCS, and output the data voltage to display panel 110.

Although not illustrated, gate driver 140, source driver 150, and/or controller 120 may be mounted on a lower panel of a display panel as a single integrated circuit (IC) chip, such as a display driver IC chip (DDI). According to exemplary embodiments, voltage generator 130 may further be mounted on the lower panel along with the DDI.

Voltage generator 130 may receive input voltage $V_{in}$, convert input voltage $V_{in}$ into an analog voltage, and output the analog voltage to gate driver 140 and/or source driver 150, which may be analog circuits of the DDI. In FIG. 7, for descriptive convenience, analog power supply AVDD is output to source driver 150 from voltage generator 130, which may be a reference voltage in generating a grayscale voltage. However, an output signal from voltage generator 130 may not be limited thereto. Referring to FIG. 8, voltage generator 130 may include DC-to-DC converter 30 and LDO regulator 20, which may include compensation circuit 200 that generates a negative capacitance.

DC-to-DC converter 30 may be applied with input voltage $V_{in}$ and switching signal SW, which may control DC-to-DC converter 30 to output regulating voltage $V_{reg}$ based on input voltage $V_{in}$ DC-to-DC converter 30 may convert input voltage $V_{in}$, of which a voltage level thereof may highly fluctuate, to regulating voltage $V_{reg}$ that has a relatively stable voltage level. However, since DC-to-DC converter 30 is driven by switching signal SW, regulating voltage $V_{reg}$ may include noise from switching operations.

LDO regulator 20 may serve as a sub-regulator to DC-to-DC converter 30. According to exemplary embodiments, LDO regulator 20 may be input with regulating voltage $V_{reg}$ as power supply $V_{dd}$, and output a stable output voltage $V_{OUT}$ by removing noise in regulating voltage $V_{reg}$ through negative capacitance formed in compensation circuit 200.

Noise from switching operations may include a high frequency component, such that regulating voltage $V_{reg}$ applied to LDO regulator 20 as power supply $V_{dd}$ includes high frequency components. In this manner, as described with reference to FIGS. 3 and 5, LDO regulator 20 according to exemplary embodiments may include compensation circuit 200 that may offset effects from parasitic capacitance $C_{p1}$ formed in (or otherwise associated with) first node $N_1$ of pass transistor $M_p$ and gate-drain capacitance $C_{gd}$, such that a voltage difference between gate and source electrodes of pass transistor $M_p$ may be removed, thereby improving a PSRR of LDO regulator 20. This may, in turn, improve display quality of display device 100.

According to exemplary embodiments, LDO regulator 20 including compensation circuit 200 may not include large capacity output load capacitor $C_L$, which is typically large in size, but may still output a stable output voltage even in high frequency ranges. As such, display device 100 may include LDO regulator 20 rather than including a large capacity output load capacitor in analog circuits of DDI, which may be used to drive display device 100 with LDO. This may enable the DDI to supply a stable output voltage and retain a small form factor. It is contemplated, however, that an output load capacitor may be utilized in association with exemplary embodiments described herein.

Although certain exemplary embodiments and implementations have been described herein, other embodiments and modifications will be apparent from this description. Accordingly, the inventive concept is not limited to such exemplary embodiments, but rather to the broader scope of the presented claims and various obvious modifications and equivalent arrangements.

What is claimed is:

1. A low drop-out (LDO) regulator, comprising:

a pass transistor configured to regulate an input according to a control signal; and a compensation circuit configured to provide a negative capacitance to a gate node of the pass transistor, wherein:

the compensation circuit further comprises a source follower circuit connected to an input terminal of a non-inverted amplifier;

the source follower circuit has a transistor comprising:

a first electrode connected to a power supply;

a second electrode connected to a current sink circuit; and a gate electrode configured to receive the control signal;

the control signal is formed based on feedback associated with the pass transistor, a reference input, and the negative capacitance; and an absolute value of the negative capacitance is substantially equivalent to a sum of a parasitic capacitance associated with a first node connected to a gate electrode of the pass transistor and a parasitic capacitance between gate and drain electrodes of the pass transistor.

2. A low drop-out (LDO) regulator, comprising:

a pass transistor configured to regulate a power supply and output an output voltage according to a control signal;

a feedback circuit configured to generate a feedback voltage based on the output voltage;

an error amplifier configured to output a comparison signal in response to a reference voltage and the feedback voltage; and a compensation circuit configured to generate a negative capacitance in association with a first node connected to a gate electrode of the pass transistor, wherein:

the compensation circuit further comprises a source follower circuit connected to an input terminal of a non-inverted amplifier;

the source follower circuit has a transistor comprising:

a first electrode connected to the power supply;

a second electrode connected to a current sink circuit; and a gate electrode configured to receive the control signal; and an absolute value of the negative capacitance is substantially equivalent to a sum of a parasitic capacitance associated with the first node and a parasitic capacitance between gate and drain electrodes of the pass transistor.

3. The LDO regulator of claim 2, wherein the pass transistor comprises:

a first electrode connected to the power supply;

a second electrode connected to a second node, the second node being configured to output the output voltage; and the gate electrode configured to receive the control signal.

4. The LDO regulator of claim 2, wherein:

an inverted terminal of the error amplifier is configured to receive the reference voltage; and the non-inverted terminal of the error amplifier is configured to receive the feedback voltage.

5. The LDO regulator of claim 2, wherein:

the pass transistor is connected to a second node, the second node being configured to output the output voltage; and an effective load capacitance is formed in association with an output terminal of the second node.

6. The LDO regulator of claim 2, wherein the compensation circuit comprises:

a non-inverted amplifier comprising:

an operational amplifier;

a first resistor; and a second resistor, the first resistor and the second resistor being connected between an output terminal of the operational amplifier and ground; and a capacitor connected to the non-inverted amplifier.

7. The LDO regulator of claim 6, wherein operational bandwidth of the operational amplifier is wider than operational bandwidth of the error amplifier.

8. The LDO regulator of claim 7, wherein at least one of the first resistor and the second resistor is a variable resistor.

9. The LDO regulator of claim 7, wherein:

a non-inverted terminal of the operational amplifier is configured to receive a signal corresponding to the control signal; and an inverted terminal of the operational amplifier is configured to receive a distributed output voltage of the operational amplifier, the distributed output voltage being distributed by the first resistor and the second resistor.

10. The LDO regulator of claim 1, wherein types of the transistor of the source follower circuit and the pass transistor are different from each other.

11. The LDO regulator of claim 5, wherein the effective load capacitance is defined by a parasitic capacitance.

12. A display device, comprising:

a display panel comprising gate lines, data lines, and pixels;

a gate driver configured to output a gate signal to the gate lines;

a source driver configured to output data voltage to the data lines; and a voltage generator configured to:

receive an input voltage;

convert the input voltage to an analog voltage; and output the analog voltage to at least one of the gate driver and the source driver, wherein:

the voltage generator comprises a direct current (DC)-to-DC converter and a low drop-out (LDO) regulator;

the LDO regulator comprises:

a compensation circuit configured to generate a negative capacitance;

a pass transistor configured to regulate an output of the DC-to-DC converter and to output an output voltage according to a control signal;

an absolute value of the negative capacitance is substantially equivalent to a sum of a parasitic capacitance associated with a first node connected to a gate electrode of the pass transistor and a parasitic capacitance between gate and drain electrodes of the pass transistor;

the compensation circuit comprises a source follower circuit connected to an input terminal of a non-inverted amplifier; and the source follower circuit has a transistor comprising:

a first electrode connected to a power supply;

a second electrode connected to a current sink circuit; and a gate electrode configured to receive the control signal.

13. The display device of claim 12, wherein:

the LDO regulator further comprises:

a feedback circuit configured to generate a feedback voltage in response to the output voltage; and an error amplifier configured to output a comparison signal in response to a reference voltage and the feedback voltage; and the compensation circuit is connected to the first node connected to a gate electrode of the pass transistor.

14. The display device of claim 13, wherein the compensation circuit further comprises:

the non-inverted amplifier comprising:

an operational amplifier;

a first resistor; and a second resistor, the first resistor and the second resistor being connected between an output terminal of the operational amplifier and ground; and a capacitor connected to the non-inverted amplifier.

15. The display device of claim 14, wherein operational bandwidth of the operational amplifier is wider than operational bandwidth of the error amplifier.

16. The display device of claim 14, wherein at least one of the first resistor and the second resistor is a variable resistor.

* * * * *